US005951273A

United States Patent [19]

Matsunaga et al.

[11] Patent Number: 5,951,273

[45] Date of Patent: Sep. 14, 1999

[54] ROTARY COMPRESSOR HAVING A PROTECTIVE COATING WHICH IS FINISH GROUND

[75] Inventors: Hiroshi Matsunaga; Shigeru Muramatsu, both of Kusatsu, Japan

[73] Assignee: Matsushita Electric Industrial Co., Ltd., Osaka, Japan

[21] Appl. No.: 08/876,958

[22] Filed: Jun. 17, 1997

[30] Foreign Application Priority Data

Jun. 19, 1996 [JP] Japan ..... 8-157943

[51] Int. Cl.[6] ..... F04C 18/356

[52] U.S. Cl. ..... 418/63; 418/178; 29/527.2; 29/888.025

[58] Field of Search ..... 418/63, 178; 29/527.2, 29/888.025

[56] References Cited

U.S. PATENT DOCUMENTS 3,829,260 8/1974 Shimoda ..... 418/178

5,263,834 11/1993 Sato et al. ..... 418/178

5,672,054 9/1997 Cooper et al. ..... 418/178

FOREIGN PATENT DOCUMENTS 4308380 10/1992 Japan ..... 29/888.025

*Primary Examiner*—John J. Vrablik

*Attorney, Agent, or Firm*—Price Gess & Ubell

[57] ABSTRACT

A tip of a vane slid with a rolling piston is mechanically finish-ground in the direction of the sliding movement between the vane and the rolling piston, and provided with a protective coating film being proof against abrasion which is composed of non-ferrous metal formed by a physical vapor deposition method, or composed of a chromium nitride compound formed by an ion plating method. Hydrofluorocarbon is employed as a refrigerant, and ester oil being compatible with the refrigerant is used as a lubricating oil.

12 Claims, 8 Drawing Sheets

ROTARY COMPRESSOR HAVING A PROTECTIVE COATING WHICH IS FINISH GROUND

BACKGROUND OF THE INVENTION

1. Field of the Invention

The present invention relates to a compressor used in a refrigerating machine, and more particularly to a rotary compressor having a rolling piston and a vane that is moved with the rolling piston.

2. Description of Related Art

Chlorofluorocarbon such as the Freon R12 and R22 have been popularly used as a refrigerant in prior arts. Specifically, R12 has been widely used for a long time as an ideal refrigerant, as it is chemically stable, nonflammable, and nonpoisonous.

It has been realized, however, that R12 contains chloric atoms in its molecules which cause destruction of an ozone layer, thus it has been desired to develop and use a substitutional refrigerant.

Hydrofluorocarbon (HFC) which contains no chlorine is considered to be a practical substitute ("Hydraulic and Pneumatic Technology", June 1994, Japan Industrial Publishing Co.).

Without chlorine, HFC has less smoothness unlike R12 or R22, thus an ice machine oil to be used therewith is required to have high compatibility with HFC, so as to cause the refrigerant to be fluently flown to every part of the compressor, as well as to keep the efficiency of a heat exchanger. Mineral oil or alkyl benzene which has been conventionally used with Freon has extremely low compatibility with the substitutional refrigerant mentioned above, thus it is considered to use an ester oil which has high compatibility with the substitute ("Hydraulic and Pneumatic Technology", June 1994, Japan Industrial Publishing Co.).

However, the employment of such substitute refrigerant and ester oil causes abrasion of metallic materials such as cast iron (ex. FC25), carbon steel (ex. S-15C), cold forged steel (ex. SWRCH1OA), alloy steel (ex. SCM435), (all designated by Japanese Industrial Standard), sintered alloy steel, and stainless steel, used as a rolling piston and a vane which are slid with each other, resulting in a shorter life of the compressor. This is because ester oil is highly absorptive due to its polar group, in addition to the fact that HFC with no chlorine has a less lubricative effect. The absorbed water dissolves the ester oil to produce carboxylic acid, which causes corrosion on the surface of the metallic materials constituting sliding members such as a vane, shortening their fatigue lives ("Hydraulic and Pneumatic Technology", June 1994, Japan Industrial Publishing Co.). The dissolution of the ester oil also produces acid which intrudes into ferrous metals and causes stress corrosion, leading to a shortened life of the vane.

The sliding contact between the rolling piston and the vane tends to fall into boundary lubrication with an oil film partly broken because of the poor lubricating ability of the substitute refrigerant. The boundary lubrication creates cohesion between the contacting members when both materials are made of steel, and the abrasion is further accelerated to shorten their fatigue lives.

The rolling piston and the vane are thus desired to have long lives as they are incorporated into a compressor which is tightly sealed and operated for a long time without maintenance.

Japanese Published Unexamined Patent Application 5-084357 discloses a compressor for refrigerating machine having one sliding member of cast iron and the other sliding member of ferrous metal coated with a compound mainly composed of chromium nitride (CrN) formed by a physical vapor deposition (PVD) method.

Japanese Published Unexamined Patent Application 7-145787 discloses a compressor for a refrigerating machine comprising a vane made of ferrous alloy steel containing chromium or ferrous sintered steel, at least its tip portion coated with Chromium nitride ceramic after being nitrided to form a compound layer with iron, chromium, and nitrogen.

These coating films mainly composed of CrN disclosed in the above Applications help the sliding members to have high resistance against abrasion even with the substitute refrigerant without chlorine and its compatible ice machine oil. Nevertheless, an adequately long life cannot still be assured, as these coating films are soon scaled off, as realized according to the experiments repeatedly carried out. Referring now to FIGS. 1A and 1B, a coating film (b) at the tip of a vane (a) is first longitudinally cracked by the sliding movement with the rolling piston and the vane (a). Then, the crack (c) is broaden by an external force shown by an arrow (F) transversely applied to the edge of the crack (c) by the fractional force between the vane (a) and the rolling piston, and filly peeled off.

The vane (a) is usually finished grinding not to give a clearance in contact between the vane (a) and the rolling piston. Nonetheless, the surface of film (b) is laterally undulated when microscopically observed, each ridge extending longitudinally in a row at the tip of the vane (a), as shown in FIGS. 1A and 1B. This is because the coating film (b) is evenly formed by the accurate ion plating method along the minute unevenness on the ground surface of the vane (a). Such evenness on the ground surface of the vane (a) is formed by grinding the vane (a) with a longitudinal movement of a grindstone (j) having a radiusing groove (k) along the tip of the vane (a) as shown in FIGS. 2 and 3.

When the vane (a) is slid with the rolling piston, a raised portion (b1) of the coating film (b) is brought into linear contact with the rolling piston, and most tightly pressed between the rolling piston and a ridge (a1) formed on the ground surface of the tip of the vane (a). It is thus assumed that the scaling of the coating film is caused by the stress of pressed contact between the vane (a) and the rolling piston, making the longitudinal crack (c) on the hard coating material of CrN at the tip of the vane (a) along the ridge line of the raised portion (b1). This phenomenon is observed irrespective of whether the coating film (b) is formed only at the tip or on the entire surface of the vane (a).

It is also possible to form such coating film (b) by PVD methods. Though any of the PVD methods including vacuum evaporation, electric discharge plating, vapor plating, etc., is applicable, the ion plating method, including the reactive ion plating method and the high frequency ion plating method, is most operable and suitable to form a coating film (b) of good adhesion.

FIG. 4 shows a PVD apparatus employing the reactive ion plating method.

The pressure in a vacuum tank (d) is kept substantially at $10^{-3}$Torr. Chromium is vaporized by an electronic gun (e) as a vapor source. An ion electrode (f) is biased with a positive voltage of about 50V for ionizing the vaporized chromium. The vaporized chromium is then beamed toward a base material (g) biased with a negative voltage, and collided thereagainst with a high kinematic energy. Nitrogen is used as a reactive gas, whereby a compound layer mainly composed of CrNx is formed on the surface of the base material (g).

However, when the vane (a) is processed as the base material to form a coating film (b) thereon by the ion plating method, electric charge is concentrated at the comers (a2, a2) of the vane (a), where the reaction and crystallization is progressed more actively than the other parts, resulting in raised parts (b2, b2) on the coating film though a micro level as shown in FIG. 5. As can be seen from FIG. 6, when the vane (a) is slid within a cylinder (i) with a micro clearance therebetween created by the raised parts (b2, b2), the cylinder (i) or the rolling piston (h) may be damaged by the raised parts (b2, b2), causing a leakage of the refrigerant, which leads to a shorter life of the product.

BRIEF SUMMARY OF THE INVENTION

In view of the foregoing, it is a primary object of the present invention to provide a long life compressor used in a refrigerating machine, having sliding members which are resistant against abrasion by a protective coating film which does not easily scale off or damage other members.

Other and further objects, features and advantages of the invention will appear more fully from the following description.

DETAILED DESCRIPTION OF THE PREFERRED EMBODIMENTS

Preferred embodiments of the present invention will be hereinafter described in conjunction with the accompanying drawings. (First embodiment)

Figure 1A:
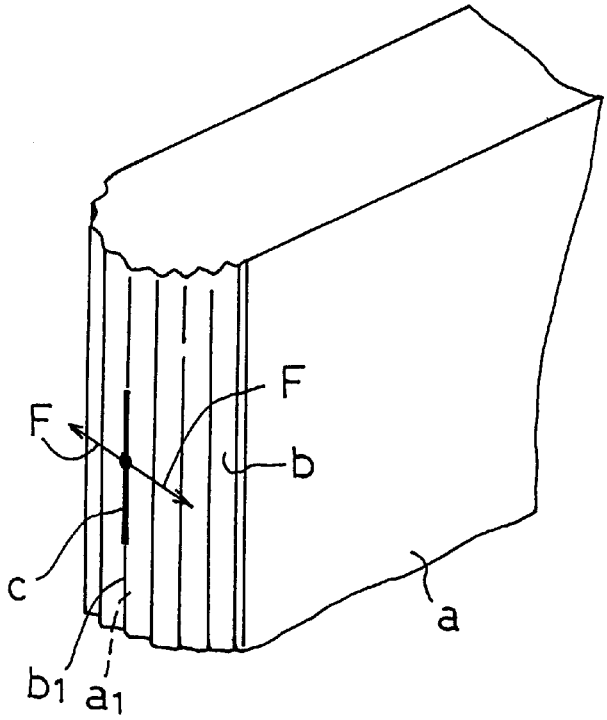
Fig. 1A Prior Art
FIG. 1A is a perspective view showing a part of a conventional vane.
Figure 1B:
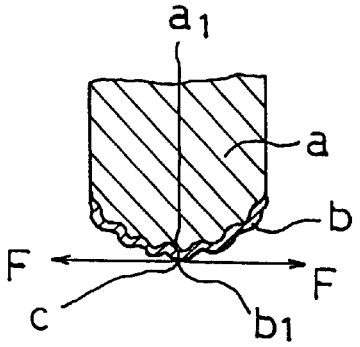
Fig. 1B Prior Art
FIG. 1B is a sectional view thereof.
Figure 2:
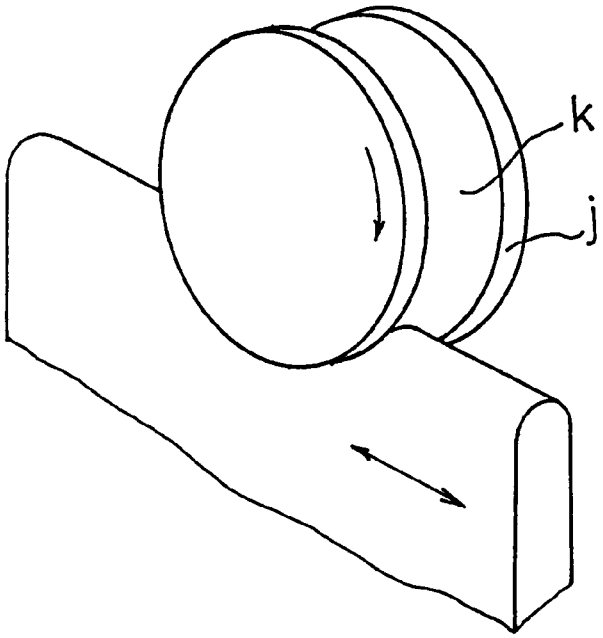
Fig. 2 Prior Art
FIG. 2 is a perspective view showing a method of processing the vane shown in FIGS. 1A and 1B.
Figure 3:
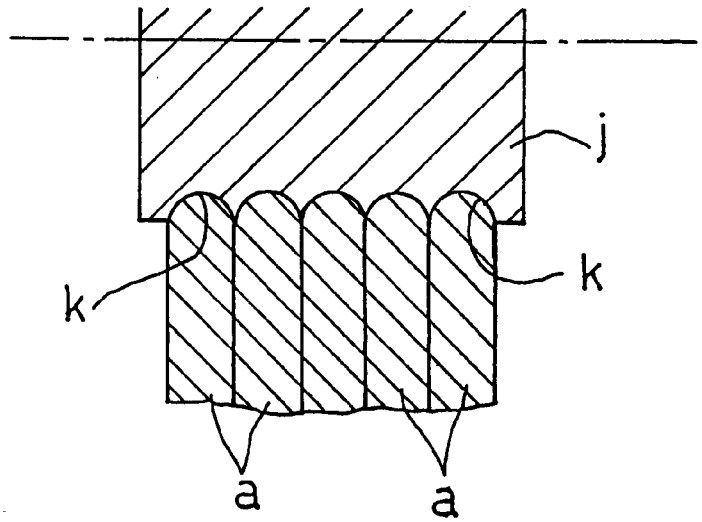
Fig. 3 Prior Art
FIG. 3 is a sectional view showing the method the vane shown in FIGS. 1A and 1B; a typical view showing a procedure of forming a coating film by an ion plating method.
Figure 4:
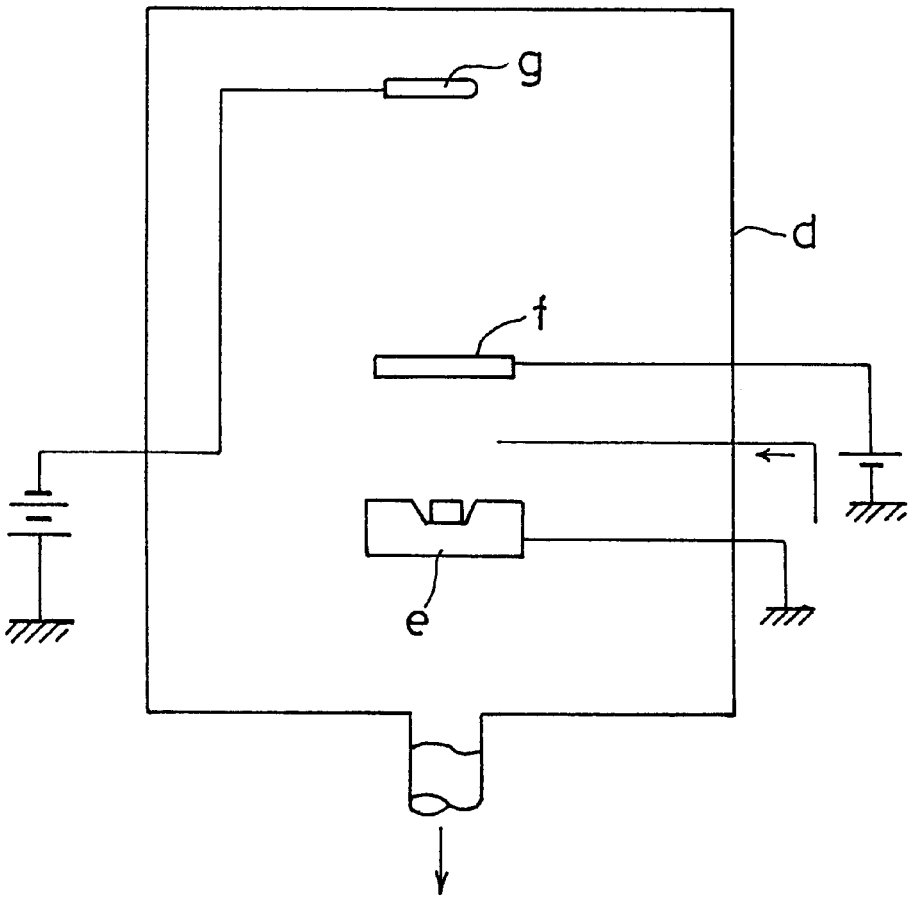
Fig. 4 Prior Art
FIG. 4 is a schematic of a conventional vapor deposition apparatus.
Figure 5:
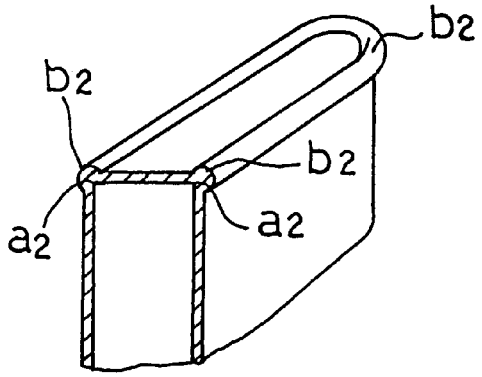
Fig. 5 Prior Art
FIG. 5 is a perspective view showing a coating film on the vane formed by a conventional ion plating method.
Figure 6:
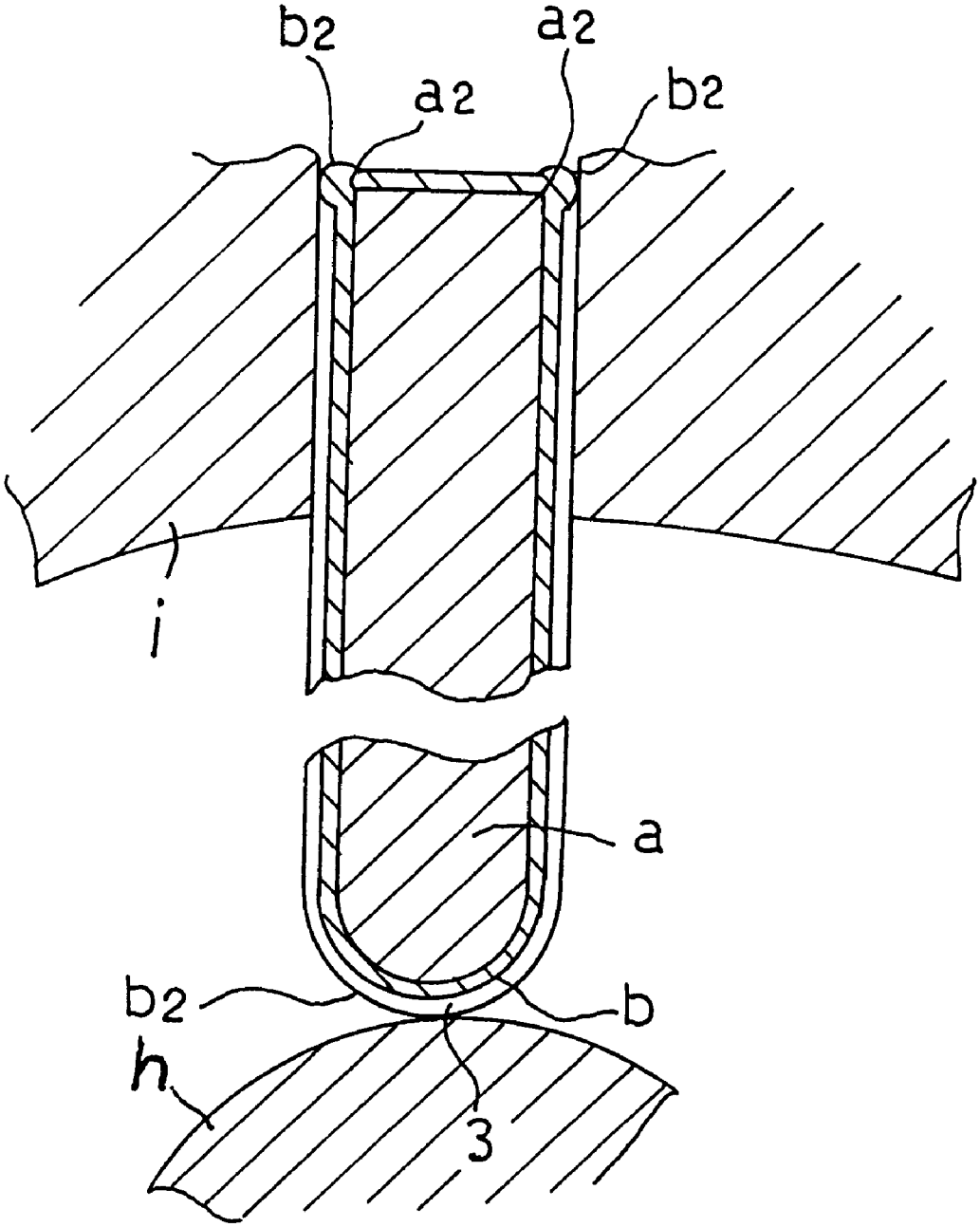
Fig. 6 Prior Art
FIG. 6 is a sectional view showing the vane of FIG. 5 being used.
Figure 7:
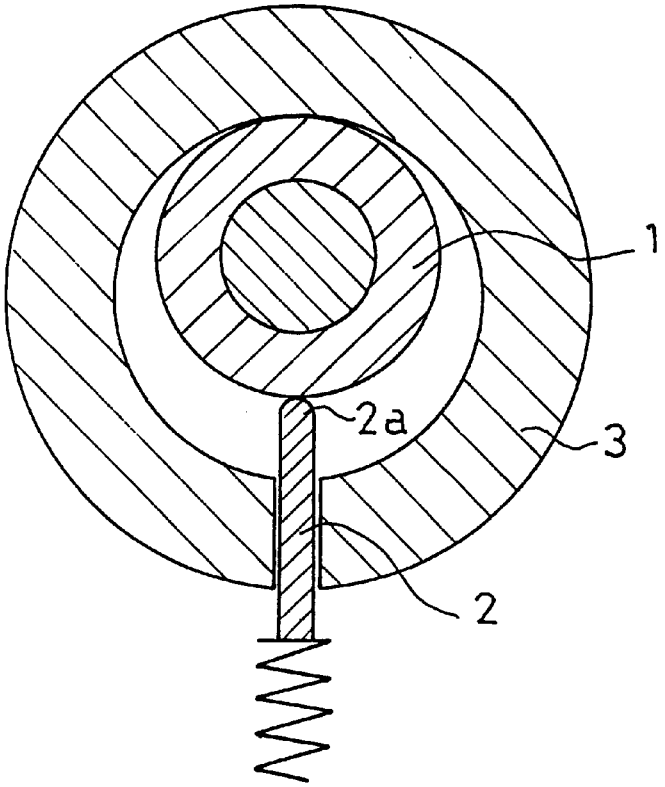
FIG. 7 is a schematic sectional view showing a rotary compressor according to one embodiment of the present invention.

Referring to FIG. 7, a rotary compressor used in a refrigerating machine according to a first embodiment of the present invention comprises a rolling piston 1 and a vane 2 driven with the rolling piston 1 in a cylinder 3. The rolling piston 1 is driven to eccentrically rotate in continual contact with the vane 2 moving smoothly therewith, thereby taking in a gas refrigerant of low temperature and low pressure into the cylinder 3, compressing it, and letting out a high temperature and high pressure refrigerant for a refrigeration cycle.

The rolling piston 1 and the vane 2 are preferably made of ferrous metals conventionally employed, such as cast iron, carbon steel, cold forged steel, alloy steel, sintered steel, stainless steel, etc. Specifically, the rolling piston 1 is preferably made of high speed steel or heat treated cast iron.

Figure 8:
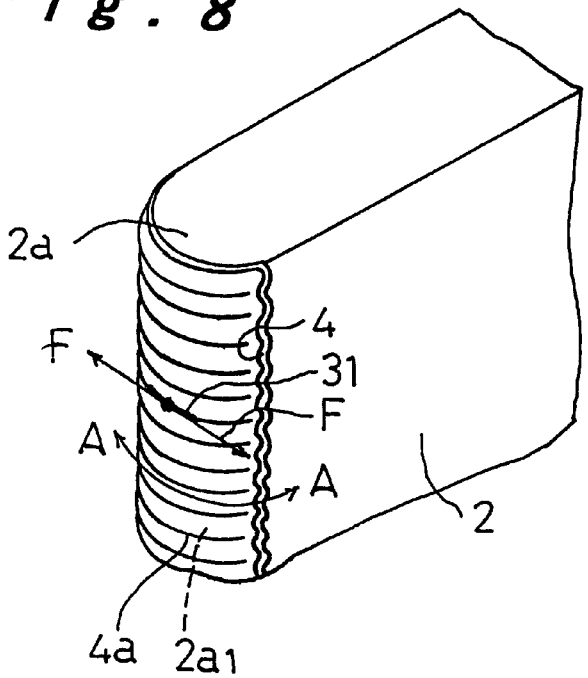
FIG. 8 is a perspective view showing a part of a vane incorporated in the compressor of FIG. 7.

The vane 2 is provided with a protective coat 4 being proof against abrasion on a ground surface of a tip 2*a* thereof. It is understood that the entire surface of the vane 2 may also be provided with the protective coat 4. As can be seen in FIG. 8, the ground surface of the tip 2*a* of the vane 2 on which the protective coat 4 is formed is mechanically finished by grinding or the like in the direction of sliding contact with the rolling piston 1 as shown by an arrow A.

Figure 10:
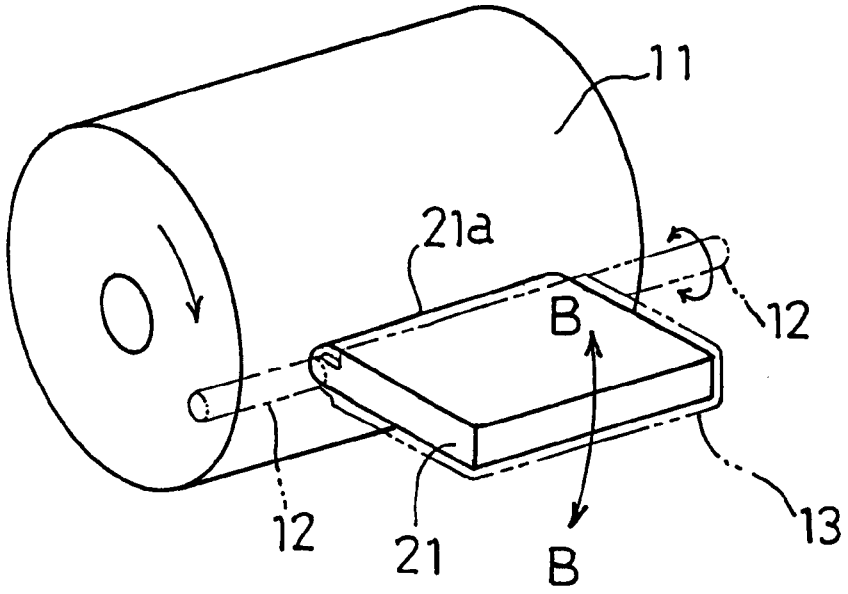
FIG. 10 is an explanatory view showing the vane of FIG. 8 being processed.

The surface of the tip 2*a* of the vane 2 is finish-ground to be laterally curved. Such finishing is accomplished, for example, as shown in FIG. 10, by contacting a tip portion 21*a* of a base material 21 for the vane 2 on a rotating cylindrical flat grindstone 11 and swinging the backside of the base material 21 in a direction shown by an arrow B. In order to finish-grind the surface in a precise circular arc, the base material 21 for the vane 2 is held in an encasement 13 being swingable around an axis 12, and the tip portion 21*a* of the base material 21 is brought into contact with a cylindrical surface of the flat grindstone 11 while the encasement 13 is swung around the axis 12 as shown in FIG. 10. The finishing may be variously accomplished other than the method described above, using other supporting or guiding mechanisms or by hand.

The ground surface of the tip 2a of the vane 2 processed as described above has unevenness as shown in FIGS. 8 and 9 as observed at a microscopic level. A row of such minute ridges is formed in the lateral direction of sliding contact with the rolling piston 1, thus the surface of the protective coast 4 provided thereon is also undulated similarly to the ground surface of the vane 2.

The abrasion-proof protective coat 4 provided at least to the tip 2*a* of the vane 2 which is slid with the rolling piston 1 is preferably composed of a CrN compound or any other metallic materials having similar properties. The protective coat 4 has characteristics of being proof against abrasion even under a condition where the vane 2 is continuously slid with the rolling piston 1, and a substitute refrigerant without chlorine and ester oil as its compatible lubricating oil are employed. The protective coat 4 has also a property to prevent cohesion between the rolling piston 1 and the vane 2 under boundary lubrication.

Figure 9:
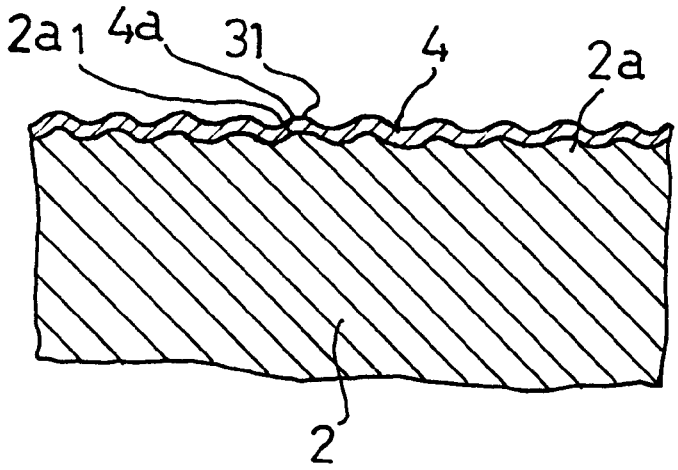
FIG. 9 is an enlarged sectional view of the vane shown in FIG. 8.

The continual and pressing contact between a ridge 4*a* of the protective coat 4 and the rolling piston 1 may occasionally cause a crack 31 on the protective coat 4 along a ridge line of a raised part 2*a*1 of the vane 2 as shown in FIGS. 8 and 9.

However, such crack 3 extends in the direction of the row of ridges 4*a* on the protective coat 4, which is the direction of the sliding contact with the rolling piston 1. Thus, an external force F of a frictional resistance caused by a sliding movement between the protective coat 4 and the rolling piston 1 is longitudinally exerted to the crack 31 as shown in FIG. 8, hence will not cause to laterally broaden the crack 31. Even though the vane 2 is made of ferrous metal and the protective coat 4 is mainly composed of a relatively hard CrN compound being prone to a crack, the crack 31 does not immediately lead to scaling of the protective coat 4, thus the abrasion-proof and cohesion preventive properties of the protective coat 4 are maintained for a longer period. The lives of the rolling piston 1 and the vane are thereby lengthened, and a longer life of the entire compressor is assured.

The protective coat 4 is most preferably formed by the PVD method which is operable and carried out at a low cost with a simple apparatus. Especially, the ion plating method provides a coating film of good adhesion, hence most suitable to form the protective coat 4.

A good result was achieved by setting surface roughness of the tip 2*a* of the vane 2 to be at a maximum range of 0.1–0.5 $\mu$m peak to valley and the thickness of the protective coat 4 formed by the PVD method to be substantially 0.5–0.6 $\mu$m. Such values of the surface roughness and the thickness are, however, not limited within these ranges.

(Second Embodiment)

Figure 11:
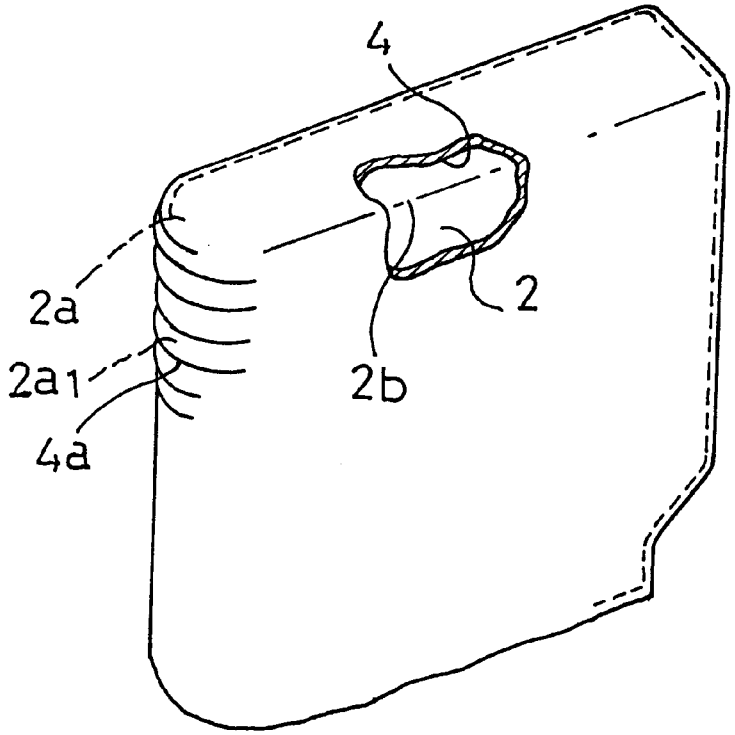
FIG. 11 is a perspective view showing a part of a vane according to a second embodiment of the present invention.
Figure 12A:
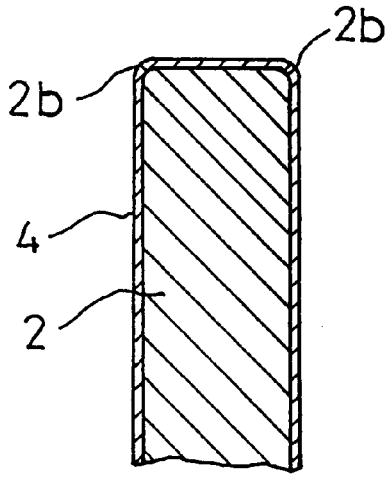
FIG. 12A is a vertical sectional view of the vane of FIG. 11 laterally cut.
Figure 12B:
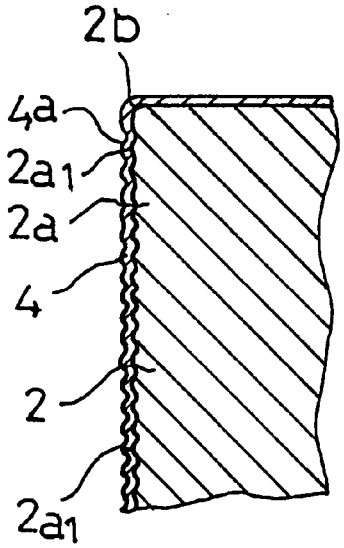
FIG. 12B is a vertical sectional view thereof longitudinally cut.

FIGS. 11 and 12 show a second embodiment of the present invention, in which the whole surface of the vane 2 is coated with the protective coat 4 formed by the ion plating method, and the vane 2 has radiused corners 2*b*. Other configurations and effects of this embodiment are identical to those of the first embodiment, thus descriptions of the identical parts given the same numericals will be omitted. The corners of the vane 2 can be readily rounded by buff grinding, NC machining, form-grinding, or any other appropriate methods.

As described above, the abrasion-proof protective coat 4 on the surface of the vane 2 is formed by thereon plating method, which allows for a provision of high adhesion to a coating film of an abrasion-proof material such as a CrN compound mentioned in the first embodiment. Further, the rounded corners 2*b* of the vane 2 prevent electrical charges from being concentrated at the corners when the protective coat 4 is being formed by the ion plating method, thereby realizing a smoother surface of the protective coat 4 without raised parts at the corners caused by the concentration of the electrical charges.

It is thus prevented that raised parts of the protective coat 4 damage other sliding members such as the rolling piston 1 or the cylinder 3 which may lead to an earlier leakage of the refrigerant. The high adhesion of the protective coat 4 ensures its longer life, being resistant against abrasion from the continuous sliding movements between the rolling piston 1 and the vane 2 even with the use of the substitute refrigerant and ester oil.

As an example of this embodiment, the radius of the rounded corners 2*b* was set to be 0.05 mm–0.5 mm, from which a good result was achieved. It is, however, also possible to set the radius of the rounded corners otherwise.

The protective coat 4 and the rounded corners 2*b* may be provided to the rolling piston 1 instead of to the vane 2, without changing any functions and effects achieved from this embodiment.

(Third Embodiment)

Figure 13:
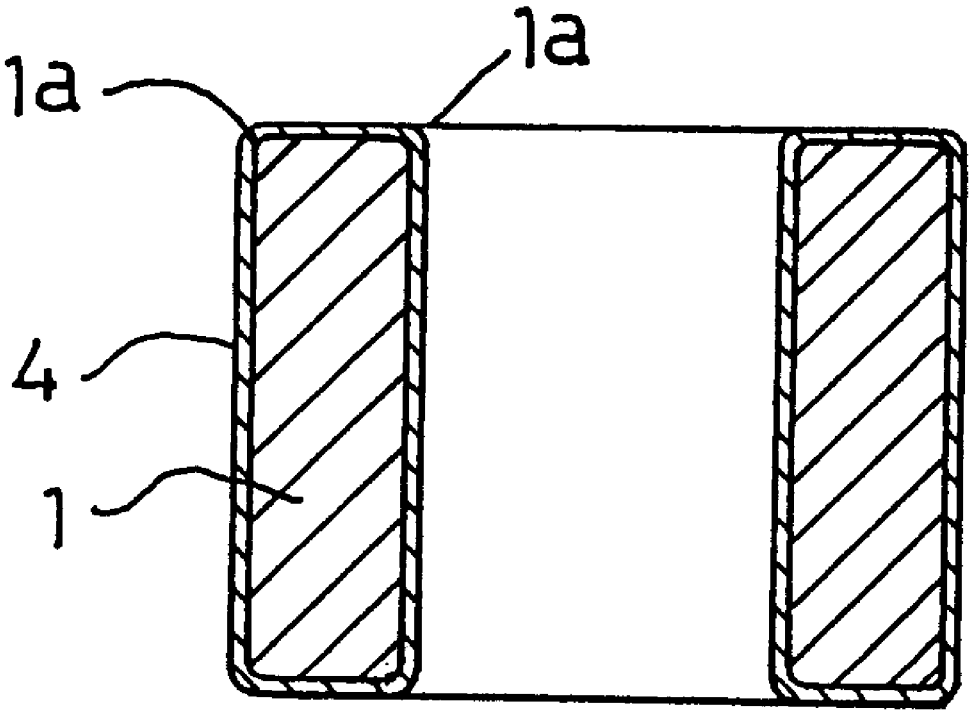
FIG. 13 is a sectional view showing a rolling piston according to a third embodiment of the present invention.

FIG. 13 shows a third embodiment of the present invention, in which the protective coat 4 is formed on the surface of the rolling piston 1 by the ion plating method, and the rolling piston 1 further has radiused corners 1*a*. The protective coat 4 functions to prevent abrasion and cohesion under the boundary lubrication between the rolling piston 1 and the vane 2, as well as to restrain any raised parts on the surface of the rolling piston 1 from damaging other sliding members such as the vane 2 or the cylinder 3, just like when it is provided on the surface of the vane 2 as described with respect to the second embodiment.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. In a compressor having an eccentrically rotating piston, the improvement of a sealing vane movably mounted to maintain contact with the rotating piston as a surface of the piston slides across a contact portion of the sealing vane for taking in a refrigerant, compressing the refrigerant and emitting the refrigerant, comprising:

a vane body; and an abrasion protective coating on the contact portion of the vane body, the contact portion formed with a plurality of minute ridges extending in a lateral direction of the sliding contact with the rotating piston.

2. A compressor used in a refrigerating machine, comprising:

a cylinder;

a rolling piston driven to eccentrically rotate in the cylinder; and a vane engaging with the rolling piston for taking in a refrigerant into the cylinder, compressing the refrigerant, and letting out the refrigerant, having a protective coating film against abrasion on a ground surface of at least a tip portion thereof, the tip portion is slid in contact with the rolling piston, the ground surface of the tip portion of the vane being mechanically finished in a direction of a sliding movement between the vane and the rolling piston, whereby minute ridges are formed in the lateral direction of the sliding movement and ridge lines, between the ridges, are formed in the direction of the sliding movement.

3. A compressor used in a refrigerating machine according to claim 2, wherein the mechanical finishing of the ground surface of the vane is accomplished by grinding.

4. A compressor used in a refrigerating machine according to claim 3, wherein the vane is composed of ferrous metal and the protective coating film is a non-ferrous metal layer formed by a physical vapor deposition method.

5. A compressor used in a refrigerating machine according to claim 4, wherein the non-ferrous metal layer is mainly composed of a chromium nitride compound.

6. A compressor used in a refrigerating machine according to claim 5, wherein the refrigerant is composed of hydrofluorocarbon, and ester oil being compatible with the refrigerant is employed as an ice machine oil.

7. A compressor used in a refrigerating machine according to claim 2, wherein the vane is composed of ferrous metal and the protective coating film is a non-ferrous metal layer formed by a physical vapor deposition method.

8. A compressor used in a refrigerating machine according to claim 7, wherein the non-ferrous metal layer is mainly composed of a chromium nitride compound.

9. In a compressor having an eccentrically rotating piston, the improvement of a sealing vane movably mounted to maintain contact with a surface of the rotating piston comprising:

a vane body member formed of a ferrous metal;

a sealing contact tip on one end of the vane body member formed with a plurality of minute ridges extending in a lateral direction of the sliding contact with the rotating piston; and a protective coating on the sealing contact tip of a chromium nitride.

10. The invention of claim 9 wherein the minute ridges have a peak to valley roughness in the range of 0.1 to 0.5 $\mu$m and the chromium nitride is substantially 0.5 $\mu$m to 0.6 $\mu$m in thickness.

11. A compressor used in a refrigerating machine, comprising:

a cylinder;

a rolling piston driven to eccentrically rotate in the cylinder; and a vane slidingly engaging with the rolling piston for taking in a refrigerant into the cylinder, compressing the refrigerant, and letting out the refrigerant, at least one of the rolling piston or the vane having a protective coating film being mainly composed of a chromium nitride compound on a ground surface thereof formed by a physical vapor deposition method, and any cornered parts of the ground surface on which the protective coating film is provided are rounded.

12. A compressor used in a refrigerating machine according to claim 11, wherein the refrigerant is composed of hydrofluorocarbon and ester oil, being compatible with the refrigerant, and is employed as a lubricating oil.

* * * * *